United States Patent [19]

Ohno et al.

[11] Patent Number: 4,573,878

[45] Date of Patent: Mar. 4, 1986

[54] VARIABLE-DELIVERY COMPRESSOR

[75] Inventors: Makoto Ohno; Hisao Kobayashi; Kimio Kato, all of Kariya, Japan

[73] Assignee: Kabushiki Kaisha Toyoda Jidoshokki Seisakusho, Kariya, Japan

[21] Appl. No.: 620,463

[22] Filed: Jun. 14, 1984

[30] Foreign Application Priority Data

Jun. 24, 1983 [JP] Japan ..... 58-98348[U]

[51] Int. Cl.[4] ..... F04B 1/18; F04B 1/28

[52] U.S. Cl. ..... 417/270; 137/854

[58] Field of Search ..... 137/854, 856; 417/269, 417/270

[56] References Cited

U.S. PATENT DOCUMENTS

| | | | |
|---|---|---|---|
| 1,768,638 | 7/1930 | Sheats | 137/854 |
| 2,106,775 | 2/1938 | Trask | 137/854 |
| 2,193,243 | 10/1937 | Teeter | 137/854 |
| 4,283,166 | 8/1983 | Hiraga | 417/269 |
| 4,403,921 | 9/1983 | Kato | 417/296 |

*Primary Examiner*—William L. Freeh

*Attorney, Agent, or Firm*—Brooks Haidt Haffner & Delahunty

[57] ABSTRACT

A variable-delivery compressor of a swashplate type having compression chambers wherein compression is effected by reciprocating movements of double-headed pistons slidably engaging a rotating swashplate in a cylinder block. The cylinder block defines compression chambers in cooperation with front and rear valve plates which have discharge ports communicating with front and rear discharge chambers one of which serves as delivery-adjusting discharge chamber. Delivery-adjusting discharge valves are disposed in the delivery-adjusting discharge chamber and carried by an actuator member which is movable between operative and inoperative positions at which the delivery-adjusting valves are operative and inoperative to close and open the discharge ports in the corresponding valve plate. The corresponding valve plate comprises a portion defining a recess opposite to each delivery-adjusting discharge valve. The recess is held in partial communication with the delivery-adjusting discharge chamber even while the delivery-adjusting discharge valve is held in contact with the corresponding valve plate.

6 Claims, 7 Drawing Figures

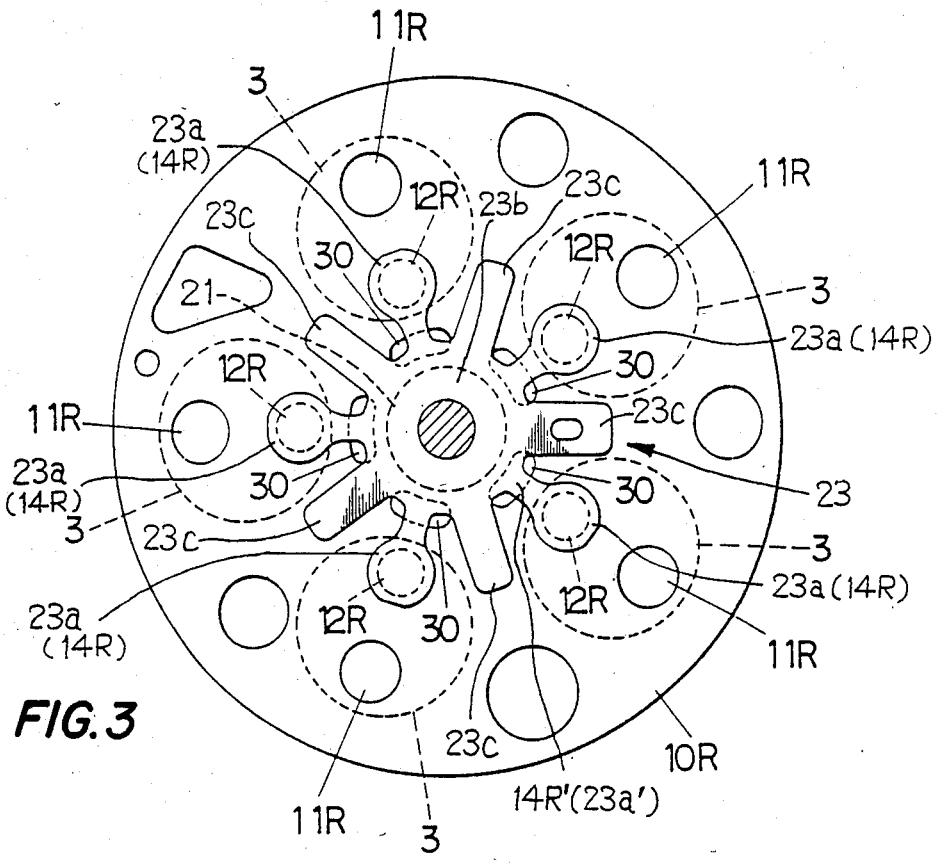
FIG. 3
FIG. 4
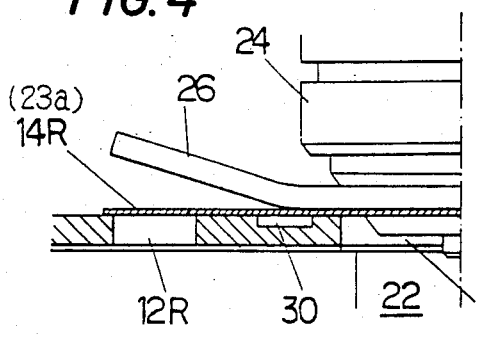
FIG. 5
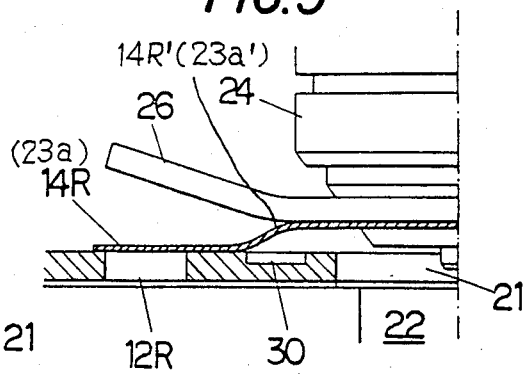

VARIABLE-DELIVERY COMPRESSOR

BACKGROUND OF THE INVENTION

The present invention relates generally to a compressor capable of adjustment of compression capacity or delivery, wherein discharge valves disposed in one of the front or rear discharge chambers are selectively placed in an operative or an inoperative position at which the appropriate front or rear discharge valves are operative or inoperative to perform their normal valving function of closing and opening the corresponding discharge ports communicating with the appropriate front or rear discharge chamber and compression chambers. More particularly, the invention is concerned with improvements in association with a delivery-adjusting mechanism which is adapted to control the position of the appropriate front or rear discharge valves in response to variation in cooling load applied to the compressor.

In the art of variable-delivery compressors of different types, various delivery adjusting mechanisms or devices are known for changing the delivery or displacement of a fluid without intermittent activation of the compressor by means of a disconnectable coupling such as an electromagnetic clutch disposed between the compressor and its drive source. In a refrigerant compressor of a swashplate type, for example, a mechanism for partially and temporarily disabling the compressor (hereinafter referred to as "disabling mechanism") is known according to Japanese Patent Application filed in the name of the assignee of the present application and laid open in 1982 under Publication No. 57-73877, which is also referred to in U.S. patent applications, Ser. No. 556,163 filed Nov. 29, 1983, and Ser. No. 589,871 filed Mar. 15, 1984, both assigned to the assignee of the present application. In the swashplate type compressor disclosed in the Publication No. 57-73877, a pair of opposed discharge chambers, front and rear, are provided adjacent to the ends of respective front and rear compression chambers which are separated by a central swashplate chamber in which a swashplate is disposed. There is also provided a disabling mechanism in association with one of the front or rear discharge chambers, for example, with the rear discharge chamber.

For example, such a disabling mechanism uses a delivery-adjusting valving member having the rear discharge valves which radially extend from the center of the valving member. This valving member is carried by an actuator which is movable axially of the compressor, between its first position adjacent to a rear valve plate in which discharge ports are formed, and its second position axially spaced from the first position. With the actuator placed in the first position, the rear discharge valves on the valving member are rendered operative to perform their normal valving function, permitting closure and opening of the rear discharge ports. In the second position, the rear discharge valves are rendered inoperative. While the compressor is at rest or operating under a low cooling load, the actuator is located, under action of biasing means, at its second position, with the discharge valves separated from the rear valve plate, thereby disabling the rear side of the compressor (rear compression chambers) from effecting a normal compressing operation, whereby the compressor is operated in the 50%-capacity mode. Upon increase of the cooling load, the actuator carrying the valving member is moved against the biasing force to the first position with a discharge pressure of the compressor applied to a specially provided pressure chamber to which the rear side of the actuator is exposed, whereby the rear discharge valves are rendered operative, and consequently the compressor is operable in its 100%-capacity mode.

Such a disabling or delivery-adjusting mechanism, however, suffers the following inconvenience when the rear discharge valves on the delivery-adjusting valving member are moved from their operative position to their inoperative position, i.e., when the compressor is switched from its 100%-capacity mode to its 50%-capacity mode.

When the actuator is started to move toward its second position to separate the rear discharge valves away from the opposite surface of the rear valve plate in order to keep open the rear discharge ports, the fixed end portions of the rear discharge valves which consist of the central base portion of the valving member are forced to be separated away from the rear valve plate. At this time, however, the pressure in a substantive number of the compression chambers (not all compression chambers) is lower than the pressure in the rear discharge chamber because the double-headed pistons in those compression chambers are more or less in their sucking stroke or in an initial stage of their compression stroke at the moment when the actuator starts to move away from the rear valve plate. Consequently, the free end portions and the adjacent intermediate portions of the rear discharge valves corresponding to those compression chambers tend to remain in contact with the rear valve plate while the fixed end portions of the same are forcibly separated from the rear valve plate. This will result in a local stress being exerted on the rear discharge valves between their fixed and free end portions, thereby causing a bending, flexure or deformation of these valves. As a result, repeated movements of the actuator and consequent bending actions of the rear discharge valves will lead to permanent deformation or even fracture of the rear discharge valves, which prevents normal functioning of the valves.

The above indicated phenomenon of the bending actions of the rear discharge valves is aggravated in the case where a pressure relief opening is provided in an central portion of the rear valve plate. Stated in more detail, the central pressure relief opening is formed opposite to the delivery-adjusting valving member which has the rear discharge valves, so that it communicates at its one end with the rear discharge chamber and at the other end with a suction space in the cylinder block and consequently with a suction inlet of the compressor. When the valving member is placed in the operative position with the actuator held in the first position, the pressure relief opening is closed by the central base portion of the valving member. In this condition, the base portion of the valving member (fixed end portions of the rear discharge valves) is held in pressed contact with the rear valve plate because the pressure in the rear discharge chamber is higher than that in the suction space in the cylinder block. Therefore, the radially inward intermediate portions of the rear discharge valves adjacent to the central base portion of the valving member are held in pressed contact with the rear valve plate. Thus, while the actuator is placed in the first position, the rear discharge valves are pressed, over a substantive area thereof, on the rear valve plate under the pressure in the rear discharge chamber. This will cause an increased tendency of flexure or bending of the rear discharge valves when they are separated from the valve plate by the actuator.

A further cause for bending actions of the rear discharge valves is an instantaneous pressure difference within the rear discharge chamber immediately after the actuator is moved toward its second position. When the central base portion of the valving member (fixed end portions of the rear discharge valves) is forcibly separated from the rear valve plate, the rear discharge chamber is brought into communication with the suction space through the open pressure relief opening. Accordingly, a radially inner portion of the rear discharge chamber adjacent to the central portion of the valving member is immediately subjected to a suction pressure in the suction space. Thus, the pressure in the inner portion of the rear discharge chamber suddenly drops to a considerable extent. On the other hand, the pressure in a radially outer portion of the rear discharge chamber adjacent to the free end portions of the rear discharge valves will tend to remain at the level immediately before the actuator is started to move. Thus, there arises an instantaneous pressure difference, between the radially inner and outer portions of the rear discharge chamber. That is, a higher pressure is applied to the free end portions of the rear discharge valves so as to keep them in contact with the rear valve plate.

As described above, the delivery-adjusting or disabling mechanism used in the known variable-delivery compressor is damaged by the respective separation of the delivery-adjusting discharge valves from the corresponding valve plate. This will result in reduced durability and reliability of the delivery-adjusting mechanism and consequently of the compressor.

SUMMARY OF THE INVENTION

The present invention was developed in view of the inconveniences experienced in the variable-delivery compressors in the prior art wherein a delivery-adjusting mechanism is incorporated for the purpose indicated above. It is accordingly an object of the invention to provide a variable-delivery compressor which is durable in use and reliable in operation.

Another object of the invention is to provide such a variable-delivery compressor with an improved delivery-adjusting mechanism which permits smooth separation of delivery-adjusting discharge valves from the corresponding valve plate, and which results in minimum damage to the discharge valves, upon activation of the mechanism to reduce the delivery of the compressor.

Another object of the invention is to provide such an improved delivery-adjusting mechanism, with minimum modification of the related parts of the compressor.

According to the present invention, there is provided a variable-delivery compressor comprising: a cylinder block having compression chambers; compression means including a drive shaft, a swashplate fixed to the drive shaft, and double-headed pistons which engage the swashplate and are slidably reciprocated in the compression chambers to compress a gas therein; a front and a rear side cover disposed at opposite ends of the cylinder block, and defining a front and a rear discharge chamber, respectively; a front valve plate having front discharge ports communicating with front halves of the compression chambers and the front discharge chamber; a rear valve plate having rear discharge ports communicating with rear halves of the compression chambers and the rear discharge chamber; discharge valves of a reed type disposed opposite to the front and rear discharge ports, respectively, each of the discharge valves having a generally elongated shape with one end portion thereof operable to close and open a corresponding one of the front and rear discharge ports; and an actuator member disposed at one of the front or rear discharge chambers which serves as a delivery-adjusting discharge chamber for adjusting the delivery of the compressor, the actuator member holding the other end portion of at least one of the discharge valves associated with the delivery-adjusting discharge chamber, the actuator member being movable between an operative position adjacent the corresponding valve plate, at which said at least one discharge valve is operative, and an inoperative position spaced away from the operative position, at which said at least one discharge valve is inoperative, said corresponding valve plate comprising a portion defining a recess opposite to an intermediate portion of said at least one discharge valve between said one and said other end portions thereof, the recess being held in partial communication with the delivery-adjusting discharge chamber even while said at least one discharge valve is held in close contact with a surface of said corresponding valve plate opposite to said at least one discharge valve.

In the variable-delivery compressor constructed as described above, the intermediate portion of each of the discharge valves carried by the actuator member is subject to a substantially identical pressure on both of its surfaces, that is, subject to a pressure in the delivery-adjusting discharge chamber, even while the discharge valve is in contact with the surface of the corresponding valve plate. Described more specifically, the surface of the discharge valve opposite to the recess formed in the corresponding valve plate is subject to a pressure in that recess, which is identical to the pressure in the delivery-adjusting discharge chamber, because the recess is formed such that it is held in partial communication with the delivery-adjusting discharge chamber even while the discharge valves held by the actuator member are kept in contact with the surface of the corresponding valve plate. With this arrangement, the intermediate portion of each discharge valve on the actuator member is easily separated from the corresponding valve plate when the discharge valves are moved away from the corresponding valve plate by an axial movement of the actuator member toward its second position upon switching of the operation mode from the 100%-capacity mode to the reduced-capacity mode. The separation of the intermediate portions of the discharge valves from the corresponding valve plate will permit the discharge valves to undergo the previously indicated flexure of deformation over their wider area. That is, the separation of the intermediate portions of the discharge valves facilitated by the recess will alleviate or mitigate the deformation of the discharge valves which is caused by a given amount of movement of the actuator member. Accordingly, the permanent deformation or bending of the discharge vavles in question is effectively minimized by means of the recess formed in the corresponding valve plate, opposite to the intermediate portion of each discharge valve actuated by the actuator member. Thus, the durability and operational reliability of the delivery-adjusting discharge valves, i.e., of the discharge valves on the actuator member, are significantly improved. Therefore, the reliability of the delivery-adjusting mechanism is considerably increased.

According to one advantageous embodiment of the invention, the actuator member holds a plurality of discharge valves associated with the delivery-adjusting discharge chamber. These plural discharge valves are provided in the form of an integral delivery-adjusting valving member carried by the actuator member. The valving member comprises a base portion and a plurality of generally elongated valving portions. The base portion is fixed to the actuator member and includes said other end portions of said plurality of discharge valves. The valving portions extend from the base portion radially of the base portion and are spaced from each other circumferentially of the actuator member. A free end part of each valving portion of the valving member serves as said one end portion of each of said plurality of discharge valves.

According to a further advantageous embodiment of the invention, said corresponding valve plate has a pressure relief opening which is formed opposite to the actuator member and which communicates with a suction space and the delivery-adjusting discharge chamber. The suction space is formed in the cylinder block so as to communicate with an inlet for introducing the gas into the compression chambers. This pressure relief opening is closed by the other end portion of the discharge valve or valves held by the actuator member when the actuator member is placed the operative position.

In accordance with a preferred form of the above embodiment, the pressure relief opening is formed in a radially central portion of the corresponding valve plate. Preferably, this centrally located pressure relief opening is adapted to be closed by the base portion of the delivery-adjusting valving member of the previously indicated embodiment. In this instance, therefore, the actuator member, the valving member and the pressure relief opening are disposed in concentric relation with each other, so that the pressure relief opening is closed by the base portion of the valving member (plural discharge valves integral at their fixed ends) while the actuator member is placed in the operative position.

In the above preferred form of the invention, the said recess in the corresponding valve plate may be embodied in various forms. According to one aspect of the invention, the recess is formed as a plurality of mutually independent arcuate recesses corresponding to the plural valving portions of the delivery-adjusting valving member. The arcuate recesses are spaced from each other along a circle concentric with the pressure relief opening. Each arcuate recess is open at opposite ends thereof to the delivery-adjusting discharge chamber even while the valving portions are held in contact with the surface of the corresponding valve plate.

In accordance with another aspect of the invention, the recess is provided in the form of an annular groove concentric with the pressure relief opening.

According to a further aspect of the invention, the recess comprises a plurality of recesses spaced from each other along a length of each of the generally elongate valving portions of the valving member. For example, these plural recesses are provided as plural radially spaced-apart annular grooves which are concentric with each other and with the pressure relief opening.

BRIEF DESCRIPTION OF THE DRAWINGS

The above and other objects, features and advantages of the present invention will be better understood from reading the following description of the preferred embodiments taken in connection with the accompanying drawings in which:

FIG. 3 is a rear end view, partially in cross section, of the compressor of FIGS. 1 and 2, showing a rear valve plate and a delivery-adjusting valving member;

FIGS. 4 and 5 are fragmentary cross sectional views in enlargement of the rear valve plate, the delivery-adjusting valving member, etc., showing two different positions of the valving member corresponding to the positions of FIGS. 1 and 2, respectively.

DETAILED DESCRIPTION OF THE PREFERRED EMBODIMENTS

Figure 1:
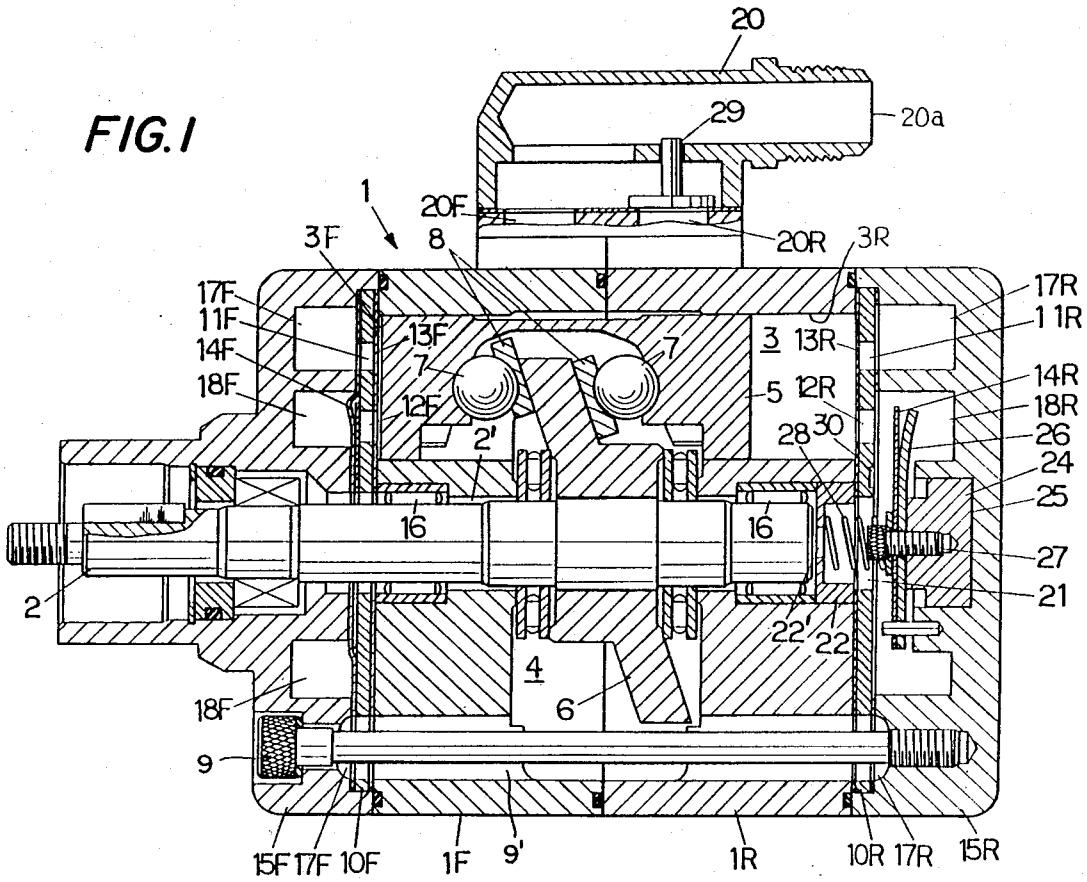
FIG. 1 is a front elevational view in cross section of a variable-delivery compressor embodying the present invention, showing its operating condition in the 50%-capacity mode.
Figure 2:
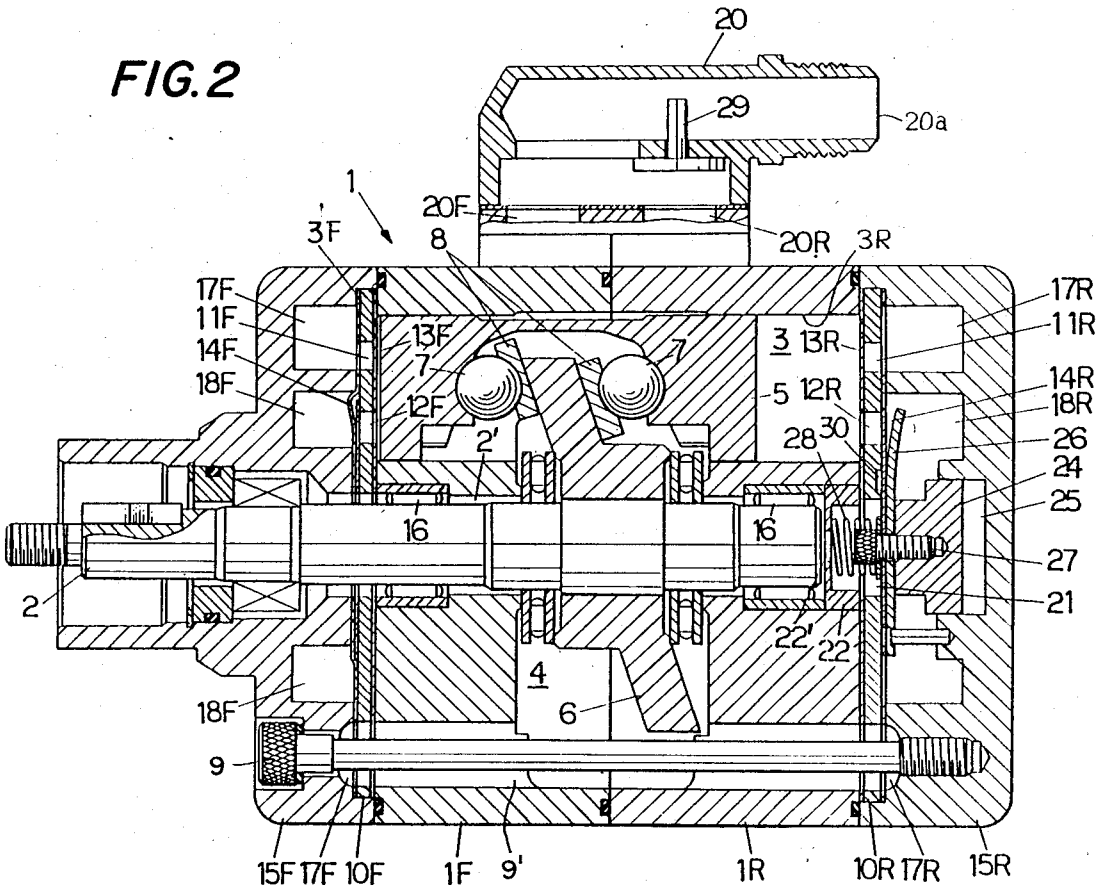
FIG. 2 is a view corresponding to FIG. 1, showing the operating condition in the 100%-capacity mode.

Referring first to FIGS. 1–2, there is shown, as a non-limiting example, a variable-delivery compressor embodying the present invention in the form of a swashplate type compressor for use in an air-conditioning system, for an automotive vehicle in particular.

The compressor has a housing comprising a first and a second housing member, that is, a cylinder block 1, and an outlet flange 20 connected to the cylinder block 1. The cylinder block 1 consists of a front cylinder half 1F and a rear cylinder half 1R, and is sandwiched at its opposite open ends by front and rear side covers 15F, 15R. These side covers 15F and 15R are gas-tightly bolted to the respective front and rear cylinder halves 1F, 1R via front and rear valve plates 10F, 10R with connecting bolts 9 which extend through all of the members to be connected together into a unitary housing. In a radially central portion of the cylinder block 1, there is formed a longitudinal shaft hole 2' which is concentric with the circumference of the cylinder block 1. A drive shaft 2 is rotatably supported in the shaft hole 2' via two spaced-apart bearings 16 provided in the hole 2'. The drive shaft 2 is connected to an engine (not shown) of the automotive vehicle through an electromagnetic clutch (not shown), whereby the drive shaft 2 is driven as required through connection and disconnection of the clutch. Around the shaft hole 2' (drive shaft 2), there are formed a plurality of bores 3 such that they are spaced from each other circumferentially of the cylinder block 1, along a circle concentric with the shaft hole 2'. The drive shaft 2 carries a swashplate 6 which is rotated thereby in a swashplate chamber 4 formed in an axially central part of the cylinder block 1. The bores 3, which are disconnected in their axially central parts by the swashplate chamber 4, accommodate respective double-headed pistons 5 each of which slidably engages the swashplate 6 via a pair of balls 7, and a mating pair of slipper shoes 8 slidably engaging opposite slant side surfaces of the swashplate 6. Upon rotation of the swashplate 6 and consequent axial oscillation thereof in a well-know manner, the double-headed pistons 5 are slidably reciprocated within the respective bores 3. With the above stated arrangement, the pistons 5 divide the bores 3 into front and rear compression chambers 3F and 3R, which are defined by the cylinder halves 1F, 1R, valve plates 10F, 10R and pistons 5. The compression in these compression chambers 3F, 3R is effected by compression means which includes the drive shaft 2, swashplate 6 and pistons 5.

The cylinder block 1 is also provided with suction holes 9′ serving also as bolt holes through which the connecting bolts 9 extend, and with discharge holes (not shown), all suction (bolt) holes 9′ and discharge holes being spaced circumferentially of the cylinder block 1, each located between the adjacent bores 3. The front and rear side covers 15F, 15R have mutually independent, annular front and rear discharge chambers 18F and 18R concentric with the cylinder block 1, and mutually independent, annular front and rear suction chambers 17F and 17R which are disposed radially outwardly of and concentrically with the discharge chambers 18F, 18R. The front and rear valve plates 10F, 10R have plural front and rear suction ports 11F, 11R communicating with the front and rear compression chambers 3F, 3R and with the suction chambers 17F, 17R. The valve plates 10F, 10R further have plural front and rear discharge ports 12F, 12R communicating with the front and rear compression chambers 3F and 3R and with the discharge chambers 18F, 18R. The suction ports 11F, 11R are closed and opened by front and rear suction valves 13F, 13R which are disposed adjacent the openings of the suction ports 11F, 11R on the side of the compression chambers 3F, 3R. Further, the discharge ports 12F, 12R are closed and opened by front and rear discharge valves 14F, 14R which are disposed adjacent the openings of the discharge ports 12F, 12R on the side of the discharge chambers 18F, 18R. These suction and discharge valves 13F, 13R, 14F, 14R are operated in response to the reciprocating movements of the double-headed pistons 5 in the compression chambers 3F, 3R.

As shown in FIG. 3, the rear discharge valves 14R are provided in the form of an integral delivery-adjusting valving member 23 which is movable as described later in greater detail, for the purpose of adjusting the delivery of the compressor. The valving member 23 comprises a plurality of generally elongated valving portions 23*a* which serve as the rear discharge valves 14R, and a circular central base portion 23*b* having a circular outer periphery from which the valving portions 23*a* extend radially such that they are spaced from each other circumferentially of the base portion 23*b*. As will be further described, the valving portions 23*a* (rear discharge valves 14R) are disposed adjacent and opposite to the rear discharge ports 12R, so that these rear discharge ports 12R are closed by the free end parts of the valving portions 23*a* when the valving member 23 is located in one of its positions adjacent to the rear valve plate 10R.

The valving member 23 further comprises a plurality of elongated rectangular support portions 23*c* which also extend radially from the base portion 23*b* such that they are disposed between the valving portions 23*a*. The functions of these support portions 23*c* will be described later.

The rear valve plate 10R further has a central pressure relief opening 21 concentric with the cylinder block 1. This pressure relief opening 21 is adapted to be opened and closed by the above-indicated delivery-adjusting valving member 23, more particularly by the base portion 23*b* of the member 23, which includes the plural discharge valves 14R (valving portions 23*a*) operable to open and close the rear discharge ports 12R. The rear cylinder half 1R has a centrally located spring seat 22 opposite to the pressure relief opening 21. The spring seat 22 has a recess communicating with the pressure relief opening 21. The bottom wall of the spring seat 22 has a through-hole 22′ which is held in communication with the pressure relief opening 21, and with the swashplate chamber 4 through the rear bearing 16 of the drive shaft 2. The swashplate chamber 4 communicates with the suction holes 9′ which communicate with the front and rear suction chambers 17F, 17R. Thus, the cylinder block 1 has a suction space consisting of the swashplate chamber 4 and the suction holes 9′ communicating with an inlet of the compressor.

In the rear side cover 15R, there is formed a pressure chamber 25 opposite to and concentric with the pressure relief opening 21 and the spring seat 22. The previously indicated delivery-adjusting valving member 23 carrying the rear discharge valves 14R are held, together with its retainer 26, by an actuator member in the form of an actuator piston 24 through a fixing screw 27. More precisely, the valving member 23 and the retainer 26 are carried at one end of the actuator piston 24. The other end of the actuator piston 24 cooperates with the rear side cover 15R to define the pressure chamber 25, and is adapted to be slidably movable along the axis of the drive shaft 2 toward and away from the rear valve plate 10R. The actuator piston 24 is biased by a coil spring 28 disposed between the actuator piston 24 and the spring seat 22, in a direction toward the bottom of the pressure chamber 25, that is, in a direction that causes the discharge valves 14R to be spaced away from the rear discharge ports 12R, as shown in FIG. 1. As indicated above and discussed later in more detail, the actuator piston 24 is adapted to be movable between its first, operative position of FIG. 2 adjacent to the rear valve plate 10R, at which the discharge valves 14R (23*a*) are operative, and its second, inoperative position of FIG. 1 spaced away from the first position, at which the discharge valves 14R (23*a*) are inoperative. In other words, the actuator piston 24, rear side cover 15R, coil spring 28, etc. constitute an important part of a disabling mechanism or a delivery-adjusting mechanism which places the rear compression chambers 3R selectively in an operative state of FIG. 2 in which the compression means is normally operative to compress the refrigerant gas within the compression chambers 3R, or in an inoperative state of FIG. 1 in which the compression means is disabled and incapable of compressing the refrigerant gas.

As indicated above, the rear discharge valves 14R are used as delivery-adjusting discharge valves in the form of valving portions 23*a* of the valving member 23 which is actuated by the actuator piston 24. In the same context, the rear discharge chamber 18R and the rear compression chambers 3R are used as delivery-adjusting discharge and compression chambers.

The outlet flange 20 introduced in the beginning portion of this detailed description, and an inlet flange not shown, are disposed radially outwardly of the cylinder block 1. The inlet flange provides a refrigerant inlet which communicates with the suction chambers 17F, 17R through the suction holes 9′. The outlet flange 20, which is attached to an outer flat surface of the cylinder block 1, at the connection of the front and rear cylinder halves 1F, 1R, provides a common refrigerant outlet 20*a* which communicates with the front and rear discharge chambers 18F, 18R through front and rear discharge passages 20F, 20R (20F not shown), respectively. The refrigerant outlet 20*a* and the refrigerant inlet (not shown) are selectively brought into communication with the pressure chamber 25 through solenoid valves (not shown). These solenoid valves are controlled in response to control signals from a sensing device (not shown) which detects a variation in cooling load applied to the compressor.

In the outlet flange 20, there is disposed a check valve 29 which is operable to block a reverse flow of the compressed gas in a direction from the front discharge chamber 18F (consequently from the outlet flange 20) toward the rear discharge chamber 18R through the rear discharge passage 20R, when the actuator piston 24 is placed in its second or inoperative position.

The rear valve plate 10R has a plurality of mutually independent, generally elongated arcuate recesses 30 corresponding to the rear discharge valves 14R (valving portions 23*a*), such that the recesses 30 are open to the rear discharge chamber 18R but, as illustrated in FIGS. 1, 2, 4 and 5, do not communicate with the rear compression chambers 3R. That is, the recesses 30 are not formed through the thickness of the rear valve plate 10R. These arcuate recesses 30 are spaced from each other along a circle concentric with the pressure relief opening 21, such that the recesses 30 are disposed between the fixed ends of the adjacent support portions 23*c* of the valving member 23, and such that a part of each recess 30 is located radially inwardly of the circular outer periphery of the base portion 23*b* of the valving member 23. Stated the other way, the arcuate recesses 30 are disposed opposite to intermediate portions 14R' (23*a'*) of the corresponding rear discharge valves 14R (23*a*), which portions 14R' (23*a'*) are rather adjacent to the base portion 23*b*. These arcuate recesses 30 are dimensioned and shaped such that each recess 30 is open at opposite ends thereof to the rear discharge chamber 18R even while the rear discharge valves (valving portions 23*a*) are held in contact with the rear valve plate 10R. Thus, the recesses 30 are adapted to be always held in at least partial communication with the rear discharge chamber 18R.

There will be described the operation of the swashplate type variable-delivery compressor constructed as described hitherto.

Immediately after the compressor has been started, the actuator piston 24 disposed in the rear side cover 15R is held, under a biasing action of the coil spring 28, at its second position of FIG. 1 while being pressed against the bottom wall of the pressure chamber 25, whereby the discharge valves 14R (valving portions 23*a*) are all spaced away from the rear discharge ports 12R. In this condition, the pressure chamber 25 is kept in communication with the refrigerant inlet (not shown), under control of the previously indicated solenoid valves (not shown). In the front compression chambers 3F, a normal compressing operation is initiated upon starting of the compressor. As indicated above, however, the rear compression chambers 3R are open to the rear discharge chamber 18R through the open discharge ports 12R, and the discharge chamber 18R is held in communication with the suction inlet of the compressor via the pressure relief opening 21, through-hole 22' and the suction space (swashplate chamber 4 and the suction holes 9'). Therefore, a normal compressing operation is not conducted in the rear compression chambers 17R. In this condition, the rear discharge passage 20R is closed by the check valve 29 in the outlet flange 20, whereby the reverse flow of the compressed gas from the outlet flange 20 to the rear discharge chamber 18R is blocked by the check valve 29.

The rotation of the drive shaft 2 in the above condition will cause the swashplate 6 to effect oscillatory rotational movements in the swashplate chamber 4. The oscillation of the swashplate 6 is transmitted to the double-headed pistons 5 through the balls 7 and the slipper shoes 8 which slidably contact the swashplate 6, whereby the double-headed pistons 5 are reciprocated in the compression chambers 3F and 3R.

In the meantime, the refrigerant gas from an evaporator of the air conditioning system is fed into the swashplate chamber 4 through a suction conduit (not shown), and the previously indicated inlet flange (not shown). The refrigerant gas directed to the swashplate chamber 4 is then fed to the front and rear suction chambers 17F, 17R through the suction holes 9'. The refrigerant gas in the front suction chamber 17F is sucked into the front compression chambers 3F through the front suction ports 11F which are opened by movements of the front suction valves 13F away from the front valve plate 10F under partial vacuum developed in the front compression chambers 3F upon a sucking stroke of the pistons 5. The gas sucked into the front compression chambers 3F is compressed by the pistons 5 upon their compression stroke, and the front discharge valves 14F are forced away from the front valve plate 10F by the compressed gas, whereby the compressed gas is discharged into the front discharge chamber 18F. Thus, the compression is achieved in the front compression chambers 3F.

However, the refrigerant gas sucked in the rear compression chambers 3R is not compressed by the reciprocating movements of the double-headed pistons 5, because the rear discharge ports 12R are held open, that is, the rear discharge valves 14R (valving portions 23*a* of the valving member 23) are located away from the rear valve plate 10R. In other words, the rear discharge chamber 18R is held in communication with the suction space 4, 9' via the pressure relief opening 21, rear bearing 16, and through-hole 22 in the spring seat 22, whereby no compression is effected in the rear compression chambers 3R as previously stated. Thus, the compressor is operated in the 50%-capacity mode.

In the 50%-capacity operation of the compressor, the compressed gas from the front discharge chamber 18F is fed toward the common outlet 20*a* through the front discharge passage 20F (not shown) and the outlet flange 20. At the same time, the pressure of the compressed gas at the common outlet 20*a* is applied to the pressure chamber 25. Upon increase of this discharge pressure above a predetermined limit, the actuator piston 24 is moved against the biasing force of the coil spring 28 to its first position adjacent to the rear valve plate 10R, whereby the rear discharge ports 12R and the pressure relief opening 21 are closed by the discharge valves 14R (23*a*) carried on the actuator piston 24. In this condition of FIG. 2 wherein the rear discharge chamber 18R is not in communication with the suction space 4, 9', a normal compressing operation is effected in the rear compression chambers 3R as well as in the front compression chambers 3F. Thus, the compressor is operated in its 100%-capacity mode.

When a cooling load in the automotive vehicle (and consequently a cooling load applied to the compressor)

has been decreased below a predetermined limit, the directional control solenoid valve is switched in response to a signal from the previously indicated load sensor (not shown) which detects the above decrease in the cooling load. As a result, the suction pressure at the refrigerant inlet of the compressor is supplied to the pressure chamber 25. In this condition, the actuator piston 24 is moved toward its second position by the coil spring 28, and the discharge valves 14R are separated from the rear valve plate 10R. Thus, the rear compression chambers 3R are disabled, i.e., unable to compress the refrigerant gas, whereby the compressor is switched into its 50%-capacity mode.

When the separation of the rear discharge valves 14R (23*a*) from the rear valve plate 10R is initiated in the condition of FIG. 4, some of the discharge valves 14R are pressed onto the rear valve plate 10R due to pressures in some of the rear compression chambers 3R wherein the double-headed pistons 5 are in their sucking stroke or in an initial stage of their compression stroke, i.e., due to the pressures in the rear compression chambers, which are lower than that in the rear discharge chamber 18R. Further, as the actuator member 24 is moved away from the valve plate 10R, the base portion 23*b* of the valving member 23 and the parts of the valving and support portions 23*a*, 23*c* adjacent to the periphery of the base portion 23*b* are separated from the rear valve plate 10R, whereby the pressure relief opening 21 is opened. Consequently, the pressure in a central portion of the rear discharge chamber 18R adjacent to the base portion 23*b* is lowered suddenly to an appreciable extent. On the other hand, immediately after the pressure relief opening 21 has been opened slightly, the pressure in a radially outer portion of the chamber 18R adjacent to the free end portions of the discharge valves 14R (valving portions 23*a*) tends to remain at the same level as it was before the chamber 18R is brought into communication with the suction space. Thus, for a very short time after the separation of the base portion 23*b* from the valve plate 10R, there is a tendency that the free end sections of the valving portions 23*a* (and the support portions 23*c* as well) remain in contact with the valve plate 10R. This causes a slight flexure or bending of those portions 23*a* (14R) and 23*c* at their intermediate sections 23*a*′ (14R′). However, this tendency of the valving member 23 is kept to a minimum by means of the arcuate recesses 30 wherein the pressure may be kept substantially equal to that in the rear discharge chamber 18R. This substantial equality of the pressure on both sides of the intermediate sections 23*a*′ (14R′) of the valving portions 23*a* (14R) contributes to easy separation of these intermediate sections 23*a*′ of the valving portions 23*a* with minimum flexure thereof, upon movement of the actuator member 24 away from the valve plate 10R. The separation of the intermediate sections 14R′ of the discharge valves 14R (23*a*) opposite to the recesses 30, as illustrated in FIG. 5, will allow the valves 14R to be flexed or deformed over their wider area except their free end parts, thereby alleviating the forced deformation of the valves 14R caused by a movement of the actuator member 24. Consequently, the free end parts of the valves 14R may be separated from the rear valve plate 10R with a relatively small distance of movement of the actuator piston 24, i.e., with a relatively small degree of flexure or deformation of the valves 14R. Hence, the rear discharge valves 14R in the form of the valving member 23 may serve for a longer period of time without deformation, fracture or damage.

To protect the peripheral edges of the base portion 23*b* between the intermediate sections 23*a*′ (14R′) and the mating surfaces of the rear valve plate 10R, the valving member 23 is provided with the support portions 23*c* which extend radially between the valving portions 23*a*. Without these support portions 23*c*, the peripheral edges of the base portion 23*b* abut on the mating surfaces of the rear valve plate 10R between the arcuate recesses 30 when the base portion 23*b* is separated from the plate 10R by the actuator piston 23, because the base portion 23*b* is deformed and its periphery is inclined with respect to the valve plate 10R. With the support portions 23*c* extending from the periphery of the base portion 23*b*, the flat surfaces at the free ends of the support portions 23*c* are held in sliding contact with the rear valve plate 10R until the valving member 23 has been completely separated from the plate 10R. Thus, the surfaces of the plate 10R are not damaged by the otherwise existing peripheral edges of the base portion 23*b*. As a result, the sealing function of the valving member 23 (base portion 23*b* thereof) is not reduced due to otherwise possible damage to the contact surfaces of the base portion 23*b* and the rear valve plate 10R.

While the invention has been described in its preferred form, it is to be understood that the invention is not limited to the precise form of the illustrated embodiment, but various changes and modifications may occur to those skilled in the art, within the scope of the invention defined in the appended claims.

For example, the dimensions and configuration of the arcuate recesses 30 may be modified within the principle of the invention which will be apparent from the foregoing description.

Figure 6:
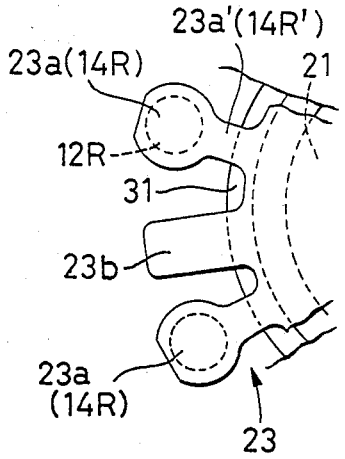
FIGS. 6 and 7 are fragmentary views, corresponding to FIG. 3, illustrating modified forms of the rear valve plate.
Figure 7:
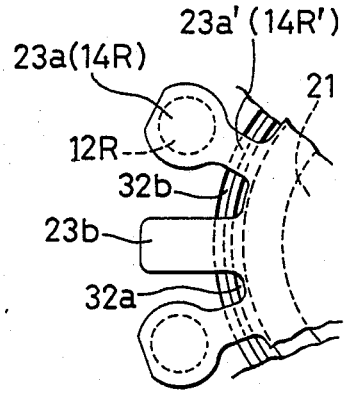

Further, the mutually independent arcuate recesses 30 in the preceding embodiment may be replaced by a single annular groove 31, as shown in FIG. 6, which is formed concentrically with the pressure relief opening 21, such that the groove 31 runs adjacent to the intermediate sections 23*a*′ of the valving portions 23. As a further alternative, plural recesses may be provided for each valving portion 23*a* (discharge valve 14R) such that they are spaced from each other along the length of the valving portion 23*a*. For example, this alternative may be provided in the form of two concentric annular grooves 32*a*, 32*b* as shown in FIG. 7, which are concentric with the pressure relief opening 21.

Although all of the rear discharge valves 14R are used as delivery-adjusting discharge valves in the form of the valving member 23 movable by the actuator piston 24, it is possible that only one or some of the rear discharge valves 14R be carried by the actuator piston 24 which may or may not be located at the radially central part of the compressor. While the rear discharge valves 14R are operated by the single actuator 24 in the illustrated embodiment, it is possible to use plural actuators to operate delivery-adjusting discharge valves. Further, the front discharge valves 14F may be controlled as the delivery-adjusting discharge valves.

What is claimed is:

1. A variable-delivery compressor comprising:

a cylinder block having compression chambers;

compression means including a drive shaft, a swashplate fixed to said drive shaft, and double-headed pistons which engage said swashplate and are slidably reciprocated in said compression chambers to compress a gas therein;

a front and a rear side cover disposed at opposite ends of said cylinder block, and defining a front and a rear discharge chamber, respectively;

a front valve plate having front discharge ports communicating with front halves of said compression chambers and said front discharge chamber;

a rear valve plate having rear discharge ports communicating with rear halves of said compression chambers and said rear discharge chamber;

a plurality of discharge valves of a reed type disposed opposite to said front and rear discharge ports, respectively, each of said discharge valves having generally elongated shape with one end portion thereof operable to close and open a corresponding one of said front and rear discharge ports; and an actuator member disposed at one end of said front and rear discharge chambers which serves as a delivery-adjusting discharge chamber for adjusting a delivery of the compressor, said actuator member holding said discharge valves associated with said delivery-adjusting discharge chamber, said actuator member being movable between an operative position adjacent the corresponding valve plate, at which said discharge valves are operative, and an inoperative position spaced away from said operative position, at which said discharge valves are inoperative, said corresponding valve plate associated with said delivery-adjusting discharge chamber having a pressure relief opening which is opposite to said actuator member and which communicates with a suction space and said delivery-adjusting discharge chamber, said suction space being formed in said cylinder block and communicating with an inlet for introducing the gas into said compression chambers, said plurality of discharge valves held by said actuator member being formed as an integral delivery-adjusting valving member, said valving member comprising a base portion fixed to said actuator member and closing said pressure relief opening when said actuator member is placed in said operative position, said valving member further comprising a plurality of generally elongated valving portions which extend from said base portion radially of the base portion and which are spaced from each other circumferentially of said actuator member, a free end part of each of said valving portions serving as said one end portion of said of said plurality of discharge valves, said corresponding valve plate comprising, between said pressure relief opening and said discharge ports, portions defining a plurality of mutually independent arcuate recesses respectively opposite to each of said generally elongated valving portions of said delivery-adjusting valving member, said arcuate recesses extending only partially into the thickness of said corresponding valve plate and being spaced from each other along a circle concentric with said pressure relief opening, each of said arcuate recesses being open at opposite ends thereof to said delivery-adjusting discharge chamber even while said valving portions of the delivery-adjusting valving member are held in contact with said corresponding valve plate.

2. A variable-delivery compressor as set forth in claim 1, wherein said base portion of the integral delivery-adjusting valving member has a circular outer periphery, a portion of each of said recesses being located radially inwardly of said base portion circular outer periphery, and a portion of each of said recesses being located radially outwardly of said base portion circular outer periphery.

3. A variable-delivery compressor comprising:

a cylinder block having compression chambers;

compression means including a drive shaft, a swashplate fixed to said drive shaft, and double-headed pistons which engage said swashplate and are slidably reciprocated in said compression chambers to compress a gas therein;

a front and a rear side cover disposed at opposite ends of said cylinder block, and defining a front and a rear discharge chamber, respectively;

a front valve plate having front discharge ports communicating with front halves of said compression chambers and said front discharge chamber;

a rear valve plate having rear discharge ports communicating with rear halves of said compression chambers and said rear discharge chamber;

a plurality of discharge valves of a reed type disposed opposite to said front and rear discharge ports, respectively, each of said discharge valves having generally elongated shape with one end portion thereof operable to close and open a corresponding one of said front and rear discharge ports; and an actuator member disposed at one end of said front and rear discharge chambers which serves as a delivery-adjusting discharge chamber for adjusting a delivery of the compressor, said actuator member holding said discharge valves associated with said delivery-adjusting discharge chamber, said actuator member being movable between an operative position adjacent the corresponding valve plate, at which said discharge valves are operative, and an inoperative position spaced away from said operative position, at which said discharge valves are inoperative, said corresponding valve plate associated with said delivery-adjusting discharge chamber having a pressure relief opening which is opposite to said actuator member and which communicates with a suction space and said delivery-adjusting discharge chamber, said suction space being formed in said cylinder block and communicating with an inlet for introducing the gas into said compression chambers, said plurality of discharge valves held by said actuator member being formed as an integral delivery-adjusting valving member, said valving member comprising a base portion fixed to said actuator member and closing said pressure relief opening when said actuator member is placed in said operative position, said valving member further comprising a plurality of generally elongated valving portions which extend from said base portion radially of the base portion and which are spaced from each other circumferentially of said actuator member, a free end part of each of said valving portions serving as said one end portion of each of said plurality of discharge valves, said corresponding valve plate comprising, between said pressure relief opening and said discharge ports, a portion defining an annular groove concentric with said pressure relief opening, said annular groove being opposite to said generally elongated valving portions of said delivery-adjusting valving member and extending only partially into the thickness of said corresponding valve plate, said annular groove being open to said delivery-adjusting discharge chamber even while said valving portions are held in contact with said corresponding valve plate.

4. A variable-delivery compressor as set forth in claim 3, wherein said base portion of the delivery-adjusting valving member has a circular outer periphery, a portion of said annular groove being located radially inwardly of said base portion circular outer periphery, and a portion of said annular groove being located radially outwardly of said base portion circular outer periphery.

5. A variable-delivery compressor comprising:

a cylinder block having compression chambers;

compression means including a drive shaft, a swashplate fixed to said drive shaft, and double-headed pistons which engage said swashplate and are slidably reciprocated in said compression chambers to compress a gas therein;

a front and a rear side cover disposed at opposite ends of said cylinder block, and defining a front and a rear discharge chamber, respectively;

a front valve plate having front discharge ports communicating with front halves of said compression chambers and said front discharge chamber;

a rear valve plate having rear discharge ports communicating with rear halves of said compression chambers of said rear discharge chamber;

discharge valves of a reed type disposed opposite to said front and rear discharge ports, respectively, each of said discharge valves having generally elongated shape with one end portion thereof operable to close and open a corresponding one of said front and rear discharge ports; and an actuator member disposed at one end of said front and rear discharge chambers which serves as a delivery-adjusting discharge chamber for adjusting a delivery of the compressor, said actuator member holding said discharge valves associated with said delivery-adjusting discharge chamber, said actuator member being movable between an operative position adjacent the corresponding valve plate, at which said discharge valves are operative, and an inoperative position spaced away from said operative position, at which said discharge valves are inoperative, said corresponding valve plate associated with said delivery-adjusting discharge chamber having a pressure relief opening which is opposite to said actuator member and which communicates with a suction space and said delivery-adjusting discharge chamber, said suction space being formed in said cylinder block and communicating with an inlet for introducing the gas into said compression chambers, said plurality of discharge valves held by said actuator member being formed as an integral delivery-adjusting valving member, said valving member comprising a base portion fixed to said actuator member and closing said pressure relief opening when said actuator member is placed in said operative position, said valving member further comprising a plurality of generally elongated valving portions which extend from said base portion radially of the base portion and which are spaced from each other circumferentially of said actuator member, a free end part of each of said valving portions serving as said one end portion of each of said plurality of discharge valves, said corresponding valve plate comprising, between said pressure relief opening and said discharge ports, respective portions each defining a plurality of recesses spaced from each other along a length of each of said generally elongated valving portions of the delivery adjusting valve member, said recesses opposite to each of said valving portions and extending only partially into the thickness of said corresponding valve plate, said recesses being open to said delivery-adjusting discharge chamber even while said valving portions are held in contact with said corresponding valve plate.

6. A variable-delivery compressor as set forth in claim 5, wherein said plurality of recesses are formed by a plurality of radially spaced-apart annular grooves which are concentric with each other and with said pressure relief opening.

* * * * *

UNITED STATES PATENT AND TRADEMARK OFFICE

CERTIFICATE OF CORRECTION

PATENT NO. : 4,573,878

DATED : March 4, 1986

INVENTOR(S) : OHNO ET AL.

It is certified that error appears in the above-identified patent and that said Letters Patent is hereby corrected as shown below:

On the title page:

In References Cited, date of Patent No. 4,283,166 should be changed from "8/1983" to --8/1981--.

Column 2, line 1, after "with", before "discharge", "a" should be changed to --the--.

Column 4, line 55, after "flexure", before "deformation", "of" should be changed to --or--.

Column 13, line 49, second of three occurrences of "said" should be changed to --each--.

Signed and Sealed this

*Twenty-ninth* Day of *July 1986*

[SEAL]

*Attest:*

*Attesting Officer*

DONALD J. QUIGG

*Commissioner of Patents and Trademarks*